United States Patent [19]

Hartlieb

[11] Patent Number: 4,527,936

[45] Date of Patent: Jul. 9, 1985

[54] AUTOMATIC PLANT FOR STACKING SHEET METAL PRESSINGS

[75] Inventor: Dieter Hartlieb, Weinsberg, Fed. Rep. of Germany

[73] Assignee: Audi Nsu Auto Union Aktiengesellschaft, Fed. Rep. of Germany

[21] Appl. No.: 491,760

[22] Filed: May 5, 1983

[30] Foreign Application Priority Data

May 15, 1982 [DE] Fed. Rep. of Germany ..... 3218450

[51] Int. Cl.[3] ..... B65H 35/00; B23Q 7/02

[52] U.S. Cl. ..... 414/47; 198/436; 414/51; 414/744 A

[58] Field of Search ..... 198/436, 486; 414/43, 414/47, 51, 53, 69, 72, 74, 744 R, 744 A, 744 B, 744 C

[56] References Cited

U.S. PATENT DOCUMENTS

| | | | |
|---|---|---|---|
| 2,881,929 | 4/1959 | Giffen | 414/122 X |
| 3,979,985 | 9/1976 | Daniels | 414/744 A |
| 4,373,840 | 2/1983 | Miller, Jr. | 414/744 A |

*Primary Examiner*—Robert J. Spar
*Assistant Examiner*—Janice Krizek
*Attorney, Agent, or Firm*—Kane, Dalsimer, Kane, Sullivan and Kurucz

[57] ABSTRACT

An automatic plant for stacking sheet steel pressings received from a press line comprises a pivotal depositing table (5) with two depositing devices (7,8) at each of which several pressings can be deposited in the stack. Associated with each depositing device is a grab (9,10) and a storage system which comprises a turntable (17,18) with two storage devices (A,B,C,D,). The storage devices of each system are charged alternately, while the other loaded storage device is replaced by an empty storage device. When one storage device is full, the relevant turntable (17,18) is rotated through 180°, so that an empty storage device replaces the loaded storage device, a distributing carriage (23) common to both turntables, picks up the loaded storage devices, shifts them to a delivery station, picks up an empty storage device at a pickup station, and brings the latter to the relevant turntable to replace the loaded storage device which has previously been collected.

3 Claims, 1 Drawing Figure

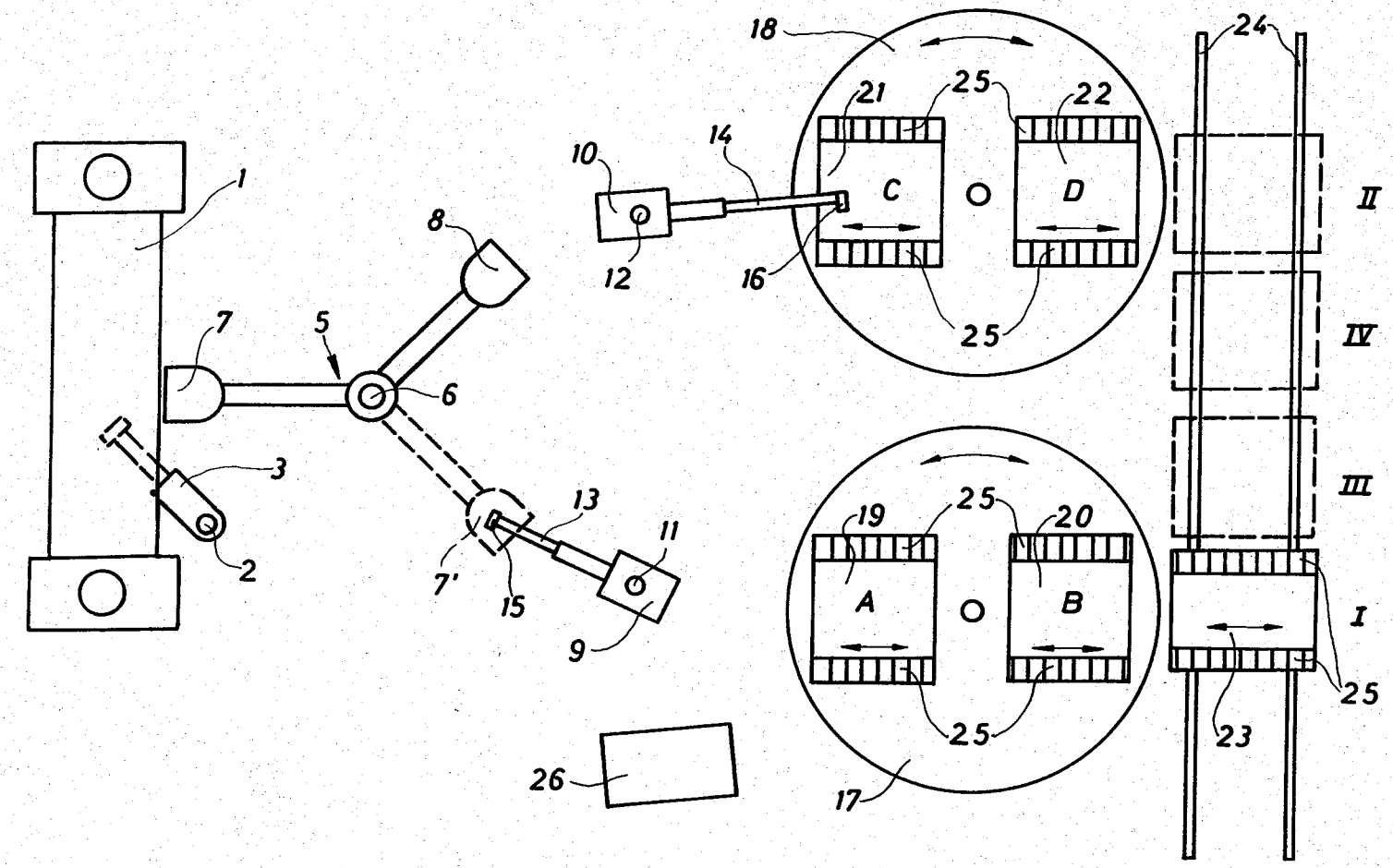
II
IV
III
I
25
24
23
22
D
20
B
25
O
25
25
O
25
21
C
19
A
17
18
16
14
12
10
11
9
13
15
7'
8
6
5
3
2
7
1
26

AUTOMATIC PLANT FOR STACKING SHEET METAL PRESSINGS

This invention relates to an automatic plant for stacking sheet metal pressings removed from a press.

Present day manufacture of complex sheet steel pressings, for example vehicle body members, is usually fully automatic, using a press line at the start of which a sheet metal blank is introduced and conveyed automatically from one press to the other, the finished pressing being removed at the exit end of the line. Normally the removal and stacking of the finished pressings has been carried out manually, because the very short cycle time of about 4 seconds, has made automatic stacking impossible.

Accordingly it is an object of the invention to provide an improved system for automatic stacking of pressings of this type.

Broadly stated the invention consists in an automatic plant for stacking sheet metal pressings removed from a press, including in combination:

(a) a pivotal depositing table with at least two depositing devices for the pressings, which can be shifted alternately between a pickup station and a delivery station by angular movement of the depositing table, (b) a grab device associated with each depositing device and arranged to swivel between a pickup point at the delivery station for the respective depositing device, and a delivery point, (c) a turntable associated with each grab device having at least two storage devices each of which by rotation of the turntable can be moved between a first position at which it receives pressings discharged at the delivery point of the respective grab device and a second position, (d) a conveying device for alternately picking up a loaded storage device in the second position of the turntable and for replacing the same with an empty storage device.

In one preferred embodiment, the depositing table has two depositing devices spaced apart at an angular interval of 135° for example, and can be swivelled through the same angle in opposite directions. A grab device and a storage system with two storage devices is provided for each depositing device. As a result of several pressings being stacked alternately by the two depositing devices of the depositing table, and the alternate operation of the two grab devices in conjunction with the storage systems coordinated with the latter, the time interval required for automatic stacking can be obtained. If, for example, 4 seconds is accepted as a cycle time for the press line and three sheet steel pressings are deposited at the depositing devices on each occasion, a cycle time of 24 seconds is provided for each of the two grab devices, which is sufficient for the grab device to move into the grabbing position, to pick up the stack at the depositing device and to convey it to the storage device. The same time interval is also sufficient to replace a full storage device by an empty storage device through the rotation of the turntable, to remove the full storage device from the turntable, and to substitute an empty storage device on the turntable.

Conventional conveying systems for the loaded storage devices or the empty storage devices can also be linked to the stacking plant.

The invention may be performed in various ways and one specific embodiment will now be described by way of example with reference to the accompanying drawing which is a plan view illustrating diagrammatically an automatic stacking plant according to the invention.

The illustrated example is an automatic stacking plant for pressed steel parts of automobile bodies, received in sequence at very short intervals from a multi-station press line. The last press of the press line is shown at 1, and from this station the finished sheet steel pressings are removed by means of a grab 3, which can be swivelled about a vertical axis 2. On the longitudinal centre line of the press line is located a depositing table 5, which can be swivelled about a vertical axis 6. The depositing table 5 has two depositing devices 7 and 8, which are spaced apart at an angular interval of about 135°, for example, and the depositing table 5 can be swivelled through the same angle 135° about the vertical axis 6 in opposite directions, (that is to say, in an anticlockwise direction from the position illustrated in the drawing) so that the depositing device 7 which is at the pickup station moves to the position 7' shown in dotted lines, at the delivery station, whilst the depositing device 8 which was previously at its delivery station moves into the vacant position of the depositing device 7 at the pickup station. From this position, the depositing table can be swivelled back again into the position illustrated.

With each depositing device 7 and 8 there is associated and coordinated an electronically controlled grab device 9 or 10, which can be swivelled about a vertical axis 11 or 12 and has a telescopic grab arm 13 or 14 with a grab head 15 or 16. The grab device 9 is illustrated in its pickup position and the grab device 10 is shown in its delivery position.

With each grab device 9 and 10 is associated a turntable 17 or 18, which has two diametrically opposite transporters or carriages 19 and 20 or 21 and 22 for a pair of movable storage devices A and B or C and D. Each turntable 17 and 18 can be rotated through an angle of 180°, so that each storage device can move between a first position where the storage devices A and C are shown in the drawing and a second position where the storage devices B and D are illustrated.

Alongside the turntables 17 and 18, a distributing carriage 23 is movable on rails 24 at right angles to the longitudinal centre line of the press line. The distributing carriage 23 can be moved in sequence into four positions, namely Position I, in which it confronts the storage device (storage device B) which is in the second position on the turntable 17, Position II, in which it confronts the storage device (storage device D) which is in the second position on the turntable 18, Position III, which provides an empty storage device pickup station, and Position IV, which provides a full storage device delivery station. Conventional conveyors for supplying empty storage devices or removing the loaded storage devices are linked with positions III and IV.

The transporters or carriages 19 and 20, and 21 and 22, and also the distributing carriage 23 are each provided with endless power conveyors 25, to move the storage devices situated thereon in the direction of the double arrows. The distributing carriage 23 is itself driven by an electric motor which is not illustrated.

In some cases the storage devices A,B,C,D, are provided with separate vertical compartments to hold the sheet steel pressings, in which case the transporters 19–22 are also provided with a timed cycling system for the timed movement of each storage device in a direction at right angles to the double arrows indicated, so that the compartments can be loaded one after the other at each position.

The plant may also include an inspection station indicated at 26, at which a stack of sheet steel pressings are deposited at certain intervals by the grab device 9 for purposes of a quality control check.

The mode of operation of the illustrated plant is as follows:

When the plant is first put into operation, all the storage devices A,B,C,D are empty. The grab 3 removes three sheet steel pressings in succession from the press 1, and deposits them in succession on the depositing device 7, which is at the pickup station. The depositing table 5 is then swivelled through 135° in an anticlockwise direction, as shown in the drawing, whereby the depositing device 7 moves into the position 7' (delivery station), and therefore into the area of operation of the grab device 9. Simultaneously, the depositing device 8 moves into the previous position of the depositing device 7, at the pickup station. The grab device 9 then removes the stack of sheet steel pressings from the depositing device 7 and conveys it onto the storage device A. Meanwhile, the grab 3 has deposited three pressings on the depositing device 8. The depositing table 5 is now swivelled through 135° in the clockwise direction, so that the depositing device 8 moves into the position illustrated (delivery station) and therefore into range of the grab device 10. The latter then picks up the stack of pressings and transfers it onto the storage device C. In this way the storage devices A and C are loaded alternately. When the storage device A is fully loaded, the turntable 17 is rotated through 180°, so that the empty storage device B replaces the storage device A. The storage device A is then pushed across onto the distributing carriage 23 and the latter is moved into position IV. There, the storage device A is collected by the delivery conveyor system, not illustrated. The now empty distributing carriage 23 is then moved into the empty storage device pickup station III, at which it receives an empty storage device from a supply conveyor, not illustrated. The distributing carriage 23 is then returned to Position I, and the empty storage device is pushed across onto the empty transporter 19 of the turntable 17.

Meanwhile, the storage device C has also been loaded, and turntable 18 is rotated through 180°, so that the storage devices C and D change places. The full storage device C is collected by the distributing carriage 23 at Position II, conveyed to Position IV, removed from there in the manner already described in connection with the storage device A, and replaced by an empty storage device. When the storage devices B and D are fully loaded, they are replaced by the empty storage devices which are now situated on the transporters 19 and 21, through the rotation of the turntables 17 and 18, and the operation already described is repeated.

All the drive units of the plant illustrated are controlled fully automatically, so that an uninterrupted sequence of operations is ensured.

I claim:

1. An automatic plant for stacking sheet metal pressings from a press, including in combination:

a first turntable with two angularly spaced depositing places which can be moved alternately between a common receiving station and two respective delivery stations by angular movement of the turntable;

a first grab device for moving one pressing after another from said press to the depositing place at the receiving station until a predetermined number of pressings are stacked on said depositing place;

second grab devices, one for each depositing place, arranged to swivel between a pickup point at the delivery station of the respective depositing place and a delivery point;

second turntables, one for each second grab device, having each at least two storage devices each of which can be moved between a first position at which it receives a stack of pressings grabbed by the respective second grab device from the respective depositing place and moved to the delivery point, and a second position by rotation of the turntable; and a conveying device for alternately picking up a loaded storage device in the second position of the respective second turntable and for replacing the same with an empty storage device.

2. A stacking plant as claimed in claim 1, in which the conveying device has a distributing carriage which can be moved between the second turntables and which cooperates in sequence with an unloading station for unloading loaded storage devices, and with a pickup station for receiving empty storage devices.

3. A stacking plant as claimed in claim 2, in which the two second turntables, one for each second grab device, each second turntable being rotatable through 180°, are provided with two diametrically arranged transporters for picking up a storage device and wherein the conveying device, which includes a distributing carriage which is common to the two second turntables, can be moved into four positions, namely a first position adjacent the second position of the storage devices located on the first second turntable, a second position adjacent the second position of the storage devices located on the second second turntable, a third position at the pickup station for picking up empty storage devices, and a fourth position at the unloading station for unloading loaded storage devices.

* * * * *